US007213313B2

(12) United States Patent
Nohara

(10) Patent No.: US 7,213,313 B2
(45) Date of Patent: May 8, 2007

(54) METHOD OF MANUFACTURING FLEECE HAVING DIFFERENT KINDS OF FIBERS IN FRONT AND BACK FACES

(75) Inventor: Shigeru Nohara, Osaka (JP)

(73) Assignee: Silver Ox Inc., Osaka (JP)

( * ) Notice: Subject to any disclaimer, the term of this patent is extended or adjusted under 35 U.S.C. 154(b) by 0 days.

(21) Appl. No.: 11/449,640

(22) Filed: Jun. 9, 2006

(65) Prior Publication Data

US 2007/0044286 A1 Mar. 1, 2007

Related U.S. Application Data

(63) Continuation of application No. PCT/JP05/15997, filed on Sep. 1, 2005.

(51) Int. Cl.
*D06C 13/00* (2006.01)
*D06C 11/00* (2006.01)

(52) U.S. Cl. ..... 28/159; 28/162; 26/2 R

(58) Field of Classification Search ..... 28/159, 28/160, 161, 162, 163, 165, 170; 428/85, 428/90–92, 95, 97; 139/391, 392, 396, 420 R, 139/428, 420 A; 66/194; 26/2 R, 7, 8 R, 26/9, 8 C, 15 R, 16, 27, 28, 29 R, 30, 37
See application file for complete search history.

(56) References Cited

U.S. PATENT DOCUMENTS

| | | | | |
|---|---|---|---|---|
| 3,191,258 | A * | 6/1965 | Spencer | 28/162 |
| 3,865,678 | A * | 2/1975 | Okamoto et al. | 428/91 |
| 4,000,342 | A * | 12/1976 | Rochelle et al. | 26/29 R |
| 4,109,038 | A * | 8/1978 | Hayashi et al. | 28/162 |
| 4,118,529 | A * | 10/1978 | Nakagawa et al. | 26/29 R |
| 4,145,467 | A * | 3/1979 | Malik | 28/159 |
| 4,316,928 | A * | 2/1982 | Otto | 26/28 |
| 5,855,125 | A * | 1/1999 | Lohmueller et al. | 66/196 |
| 6,866,911 | B1 | 3/2005 | DeMott et al. | |
| 2004/0045143 | A1* | 3/2004 | Rock et al. | 28/159 |
| 2004/0224121 | A1* | 11/2004 | Sheppard | 139/396 |

FOREIGN PATENT DOCUMENTS

| | | |
|---|---|---|
| JP | 57-101064 | 6/1982 |
| JP | 59-187664 | 10/1984 |
| JP | 42-18427 | 8/1992 |
| JP | 9-95859 | 4/1994 |
| JP | 2002-88622 | 10/2003 |
| JP | 2003-41460 | 2/2006 |

* cited by examiner

*Primary Examiner*—Amy B. Vanatta
(74) *Attorney, Agent, or Firm*—Stites & Harbison PLLC; Douglas E. Jackson

(57) ABSTRACT

A method of manufacturing a fleece having different kinds of fibers in the front and back faces includes the steps of: weaving an extra-fine polyester fiber or acrylic fiber in a high gauge to have dense loops to form the front face of loop piles (1), and weaving a natural fiber such as cotton or silk as a ground yarn (2) of the back face; cutting the tip parts of the loop piles (1) formed in the weaving step so as to form cut piles (3); raising the cut piles (3) so as to form a raised fiber group (4); trimming the raised fiber group (4); causing pilling (5) in the raised fiber group (4) trimmed, by a contact friction; trimming the raised fiber group (4) at least once so as to form short raised fiber group (4).

4 Claims, 2 Drawing Sheets

METHOD OF MANUFACTURING FLEECE HAVING DIFFERENT KINDS OF FIBERS IN FRONT AND BACK FACES

CROSS-REFERENCE TO RELATED APPLICATIONS

This application is a continuation of International Application No. PCT/JP2005/015997, filed Sep. 1, 2005 (which is hereby incorporated by reference).

TECHNICAL FIELD

The present invention relates to a method of manufacturing a fleece in which fiber materials for the front face and the back face are different. In more detail, the present invention relates to a method of manufacturing a fleece in which the front face is made of polyester fibers or acrylic fibers and the back face is made of natural fibers such as cotton or silk.

BACKGROUND ART

In recent years, a so-called fleece, in which polyester fibers are pile-woven and loop piles protruding on the front and back faces are cut and raised, is in fashion as a warm outer ware. Since the fleece is hefty, soft, light and excellent in heat retention, it is widely used for warm clothes particularly.

The fleece is typically woven by a double-side pile weaving machine. The length of loop piles of the polyester fibers protruding on the front face and the back face is adjusted by height adjustment in a sinker nose of the weaving machine, and then the loop piles are shirring-cut and raised, whereby a raised fabric called fleece is made (see, for example, Patent Document 1).

Patent Document 1: Publication of Japanese Patent Application Laid-open No. 2003-41460. However, in the fleece disclosed in Patent Document 1 mentioned above, the pile yarn is relatively wide of 2 to 2.5 denier and is a polyester long yarn having 5 to 10 mm length, and the loop density is non-dense. Therefore, there have been such problems of lack of flexibility, naps being easily fallen off and cold due to too-much ventilation. In particular, since a conventional fleece has long naps, there has been a problem that naps are intertwined with each other when washed so the fleece becomes hardened, whereby the touch and the texture are worsened. Further, a fleece made of polyester materials having high strength and extensibility has a problem of pills being easily caused, called pilling, since the fleece contacts or slidingly contacts other clothes during wearing, naps of yarns are rustled or rubbed by a contact friction with other clothes, or intertwined with each other, during washing. On the other hand, generation of static electricity is another problem for a fleece that the front and back faces thereof are made of polyester materials. Generation of static electricity is a phenomenon in which on two objects in an electrically neutral state originally, one polarity charges become excessive than the other, either positive or negative, along mainly with a mechanical movement such as contact, separation or the like of the two objects. As for the static electricity, the electrification amount increases when wearing synthetic fibers together such as polyester fibers and nylon fibers, whereby static electricity of unpleasant "crackle feeling" we experience typically is generated. Further, there is a problem that the fleece is easily get dirty with dirt and dust being attached in the condition of dry winter time. The present invention is researched and developed in order to solve the problems described above. It is therefore an object of the present invention to form a fleece which is supple, soft and good touch capable of creating stretching property as if natural, and to create a high quality fleece capable of preventing pilling and preventing adhesion of dirt and dust by reducing generation of static electricity.

DISCLOSURE OF THE INVENTION

As a means for solving the problems described above and achieving the object, in the present invention, there is developed and adopted a method of manufacturing a fleece having different kinds of fibers in the front and back faces, comprising the steps of: weaving extra-fine polyester fibers or acrylic fibers in a high gauge to have dense loops to form the front face of loop piles, and weaving natural fibers such as cotton or silk as a ground yarn of the back face; cutting tip parts of the loop piles formed in the weaving step so as to form cut piles; raising the cut piles so as to form a raised fiber group; trimming the raised fiber group; causing pilling in the raised fiber group trimmed, by a contact friction; and trimming the raised fiber group at least once so as to form a short raised fiber group.

Further, in the method of manufacturing a fleece having different kinds of fibers in the front and back faces configured as described above, there are developed and adopted a method of manufacturing a fleece having different kinds of fibers in the front and back faces in which the raised fiber group is extra-fine polyester or acrylic filament cluster yarns close to micro denier, and a method of manufacturing a fleece having different kinds of fibers in the front and back faces in which the short raised fiber group is trimmed to have a length of 1.0 to 3.0 mm.

In the present invention, extra-fine polyester fibers or acrylic fibers are made into loop piles woven in a high gauge so as to be dense loops on the front face, and the tip parts of the loop piles are cut to form cut piles and to form a short raised fiber group through respective steps of raising, trimming, pilling and trimming. Therefore, a fleece which is supple and extremely good touch with soft stretching property can be obtained. Further, a fleece can be obtained in which pilling can be suppressed, anti-pilling property will not be reduced although washed repeatedly or worn for along time, and the quality and the appearance remain good.

Further, since the back face is formed using natural fibers such as a cotton yarn or a silk yarn as a ground yarn, the electrification amount will not increase as the case of synthetic fibers. Therefore, it is possible to effectively suppress generation of static electricity caused when layering or taking off, so a fleece having less adhesion of dirt or dust can be obtained.

BEST MODE FOR CARRYING OUT THE INVENTION

Figure 1:
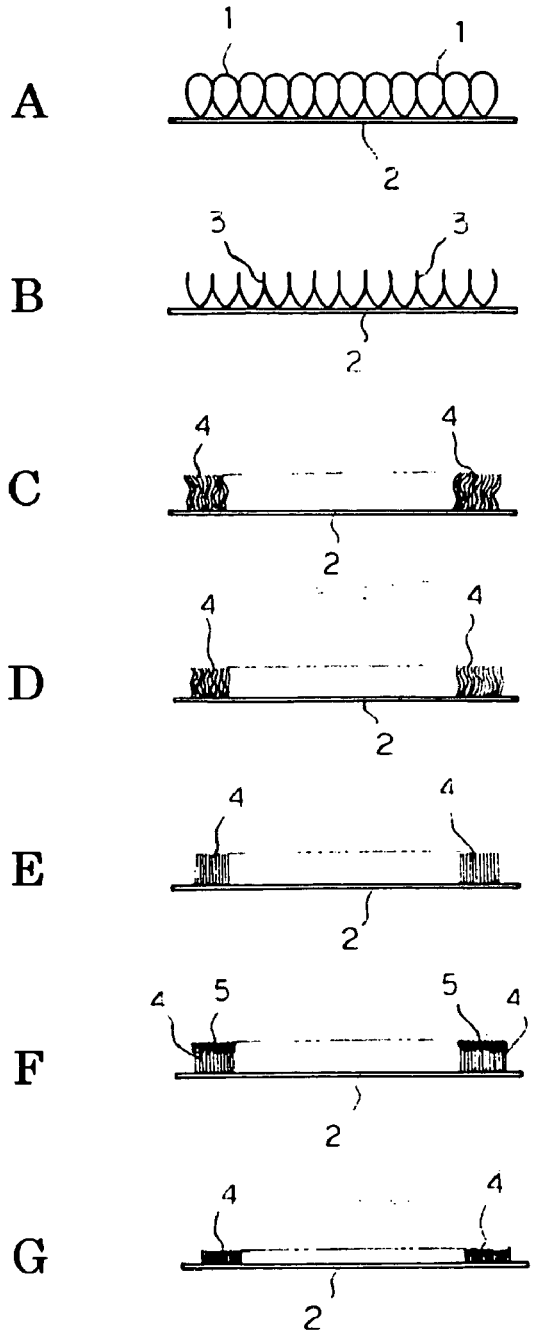
FIG. 1 is an illustration of steps of a method of manufacturing a fleece having different kinds of fibers in the front and back faces according to the present invention.
Figure 2:
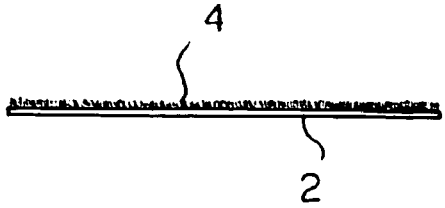
FIG. 2 is a front view of a fleece having different kinds of fibers in the front and back faces, formed by the manufacturing method according to the present invention.
Figure 3:
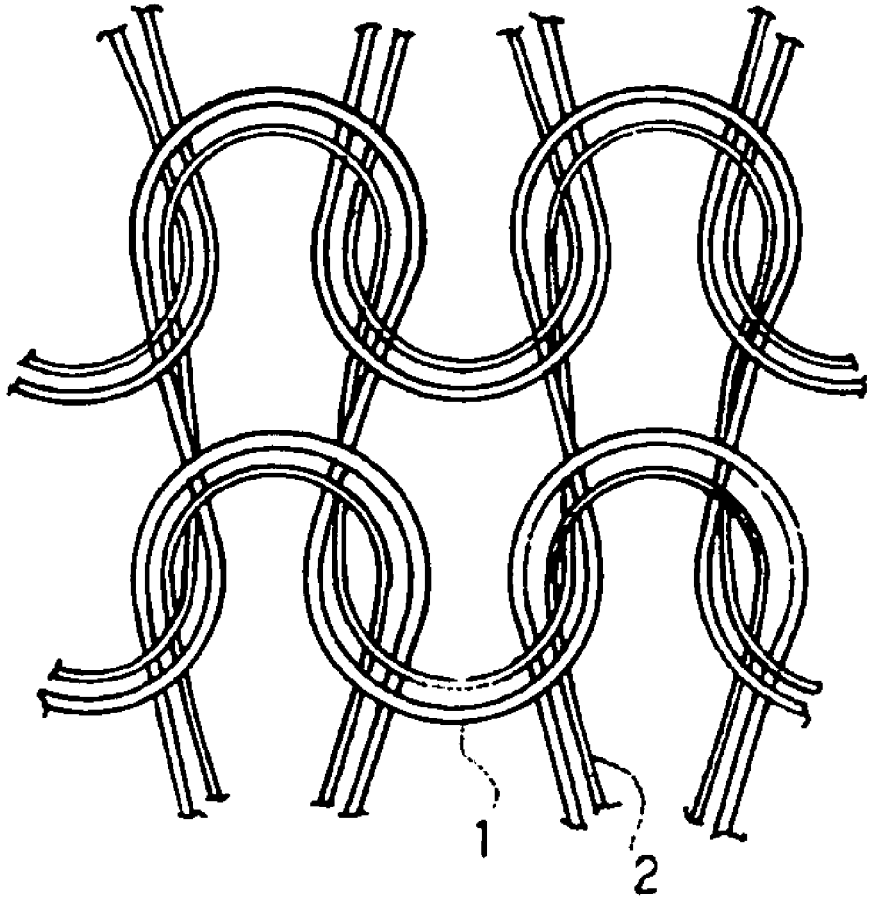
FIG. 3 is an illustration showing the weave structure of a fleece having different kinds of fibers in the front and back faces.

Hereinafter, an embodiment of the present invention will be explained.

In a method of manufacturing a fleece having different kinds of fibers in the front and back faces according to the present invention, pile weaving is performed with a sinker pile machine having an aperture of 30 inches and 20 to 24 weaving gauge. A woven fabric is so formed that the front face is formed of loop piles 1 and the back face is formed of a ground yarn 2, the loop piles 1 of the front face are drawn and aligned and the tip parts thereof are cut to be cut piles 3 which are raised to be a raised fiber group 4, and after trimming, naps and pills 5 are caused in the raised fiber group 4 by a contact friction, and trimming is performed again so as to form a short raised fiber group 4.

As fibers of the loop piles 1 on the front face, a polyester or acrylic yarn is used. As the ground yarn of the back face, a yarn of natural fibers such as a cotton yarn or a silk yarn is used, whereby the electrification amount is reduced and generation of static electricity is suppressed.

The polyester or acrylic yarn of the loop pile 1 is in an extra-fine size of 0.3 to 1.5 denier which is close to micro denier so as to create delicacy and softness against hardness that the polyester and acryl originally have. If the yarn is 0.3 denier or less, it is not suitable since the fabric has no elasticity because it is too supple. On the other hand, if the yarn is 1.5 denier or more, it is not suitable since the texture becomes hard so the soft feeling is lost. Therefore, a range from 0.3 to 1.5 denier mentioned above is preferable. Further, as a fiber length, 1.0 mm to 3.0 mm is preferable considering the texture and the soft feeling. As for the yarn, a hollow yarn or one added functional effects such as antibacterial property, UV resistance, or far infrared processing may be used, besides a typical yarn of round cross-section.

Further, as the ground yarn 2, a cotton yarn or a silk yarn may be used. In the case of a cotton yarn, it is preferable to use yarn numbers 30/1 to 40/1 which is suitable in thickness and weight (gross weight) of the fabric. The yarn number 30/1 or less is not suitable since the fabric becomes thick and heavy, and the yarn number 40/1 or more is not suitable since the fabric becomes too thin so that the elasticity is lost and the strength is also affected. Therefore, as for the thickness of a cotton yarn, yarn numbers 30/1 to 40/1 are preferable. Further, in the case of a spun silk yarn (cut fiber), 100/2 to 140/2 are suitable, and in the case of filament, about 180 denier to 130 denier are suitable. Those exceeding these ranges are not suitable due to the same reasons as the case of the cotton yarn described above.

The cut piles 3 are formed by cutting the tip parts of the loop piles 1 with a roll spiral cutter or the like, and the raised fiber group 4 is formed in such a manner that the cut piles 3 are processed by a raising machine so as to be raised. To the raised fiber group 4, brush processing for aligning vertically and pilling raising processing, in which the tip parts of the raised fiber group 4 are applied with contact friction so as to cause pills 5, are performed. Then, trimming is carefully performed at least once, whereby naps of the raised fiber group 4 are made into short raised fiber group 4 so as to prevent pilling from being caused.

EXAMPLE 1

Hereinafter, the present invention will be explained in detail through examples and comparative examples.

A sinker pile machine (TYTD manufactured by Tenyou Harioriki, 30-inch aperture, weaving gauge 24) was used, and a woven fabric was woven in which the front face was formed of loop piles 1 using polyester 75*d*/144*f*, and a cotton yarn number 40/1 was used as the ground yarn 2 (FIG. 1A).

The weight of the woven fabric was 160 g/m2, and the height of the loop piles 1 was 3.0 mm. The loop piles 1 were drawn to be aligned and the tip parts were cut with a roll spiral cutter so as to make the height of the cut piles 3 to be 2.8 mm (FIG. 1B).

The cut piles 3 were processed by a raising machine so as to be raised to form the raised fiber group 4 (FIG. 1C).

The raised fiber group 4 was trimmed with a roll spiral cutter so as to have a height of 2.0 mm (FIG. 1D).

Next, brush processing was performed to align the raised fiber group vertically (FIG. 1E).

A contact friction was applied to the raised fiber group 4, and pilling raising processing was performed to form naps and pills 5 at the tip parts (FIG. 1F).

Then, the tip parts were trimmed with a roll spiral cutter so as to obtain a fleece of the short raised fiber group 4 having a height of 1.5 mm (FIG. 1G).

COMPARATIVE EXAMPLE 1

A weaving machine and an aperture same as those of the example 1 and weaving gauge 22 were used, and a fleece was obtained in which polyester 100*d*/144*f* was used as a pile yarn of the front face, polyester 75 denier was used as the ground yarn, polyester 100*d*/144*f* was used as a pile yarn of the back face, the fiber length was 2.0 mm, and the weight was 160 g/m2.

EXAMPLE 2

A weaving machine and an aperture same as those of the example 1 and weaving gauge 22 were used, and a woven fabric was woven in which the front face was formed of loop piles 1 using polyester 100*d*/144*f*, and a cotton yarn number 36/1 was used as the ground yarn 2 (FIG. 1A).

The weight of the woven fabric was 200 g/m2, and the height of the loop piles 1 was 3.0 mm. The loop piles 1 were drawn to be aligned and the tip parts were cut with a roll spiral cutter so as to make the height of the cut piles 3 to be 2.8 mm (FIG. 1B).

The cut piles 3 were processed by a raising machine so as to be raised to form the raised fiber group 4 (FIG. 1C).

The raised fiber group 4 was trimmed with a roll spiral cutter so as to have a height of 2.2 mm (FIG. 1D).

Next, brush processing was performed to align the raised fiber group vertically (FIG. 1E).

A contact friction was applied to the raised fiber group 4, and pilling raising processing was performed to form naps and pills 5 at the tip parts (FIG. 1F).

Then, the tip parts were trimmed with a roll spiral cutter so as to obtain a fleece of the short raised fiber group 4 having a height of 1.5 mm (FIG. 1G).

COMPARATIVE EXAMPLE 2

A weaving machine and an aperture same as those of the example 1 and weaving gauge 20 were used, and a fleece was obtained in which polyester 100*d*/144*f* was used as a pile yarn for the front face, polyester 100 denier was used as the ground yarn, polyester 100*d*/144*f* was used as a pile yarn for the back face, the fiber length was 2.5 mm, and the weight was 200 g/m2.

EXAMPLE 3

A sinker pile machine (DF-3 manufactured by Fukuhara Seiki, 30-inch aperture, weaving gauge 20) was used, and a woven fabric was woven in which the front face was formed of loop piles 1 using polyester 150*d*/144*f*, and a cotton yarn number 30/1 was used for the ground yarn 2 (FIG. 1A).

The weight of the woven fabric was 280 g/m2, and the height of the loop piles 1 was 3.5 mm. The loop piles 1 were drawn to be aligned and the tip parts were cut with a roll spiral cutter so as to make the height of the cut piles 3 to be 3.2 mm (FIG. 1B).

The cut piles 3 were processed by a raising machine so as to be raised to form the raised fiber group 4 (FIG. 1C).

The raised fiber group 4 was trimmed with a roll spiral cutter so as to have a height of 2.5 mm (FIG. 1D).

Next, brush processing was performed so as to align the raised fiber group vertically (FIG. 1E).

A contact friction was applied to the raised fiber group 4, and pilling raising processing was performed to form naps and pills 5 at the tip parts (FIG. 1F).

Then, the tip parts were trimmed with a roll spiral cutter so as to obtain a fleece of the short raised fiber group 4 having a height of 2.0 mm (FIG. 1G).

COMPARATIVE EXAMPLE 3

A weaving machine, an aperture and a weaving gauge same as those of the example 3 were used, and a fleece was obtained in which polyester 150*d*/144*f* was used as a pile yarn for the front face, polyester 100 denier was used as the ground yarn, polyester 100*d*/144*f* was used as a pile yarn for the back face, the fiber length was 3.0 mm, and the weight was 280 g/m2.

The evaluation results of fleeces having different kinds of fibers in the front and back faces obtained as described above are shown in Table 1 below. Note that in Table 1, the examples 1 to 3 are abbreviated as Ex. 1 to 3, and the comparative examples 1 to 3 are abbreviated as Com. 1 to 3.

TABLE 1

| | Ex. 1 | Ex. 2 | Ex. 3 | Com. 1 | Com. 2 | Com. 3 |
|---|---|---|---|---|---|---|
| Electrification Voltage (V) | 480 | 1800 | 2700 | 6500 | 7300 | 7600 |
| Pilling property (grade) | 5 | 4–5 | 4 | 2–3 | 2–3 | 2 |
| Reduction Ratio (%) | −3.4 | −2.4 | −0.8 | −0.5 | −0.5 | −0.5 |
| Nap Adhesion (grade) | 4–5 | 4 | 3–4 | 2–3 | 2–3 | 2–3 |
| Soft Feeling | ○ | ○ | ○ | ○ | ○ | Δ |
| Warmth | ○ | ○ | ○ | ○ | ○ | ○ |
| Sweat/Moisture Absorption | ○ | ○ | Δ | x | x | x |

Evaluation in Table 1 above was performed as follows:

For the electrification voltage (static electricity), the voltage of static electricity generated by processing a test fabric with a friction machine, under the condition of a temperature of 20° C. and a humidity of 40%, was measured (JIS L1094-1997: Friction electrification voltage measurement method).

For the pilling property, a test fabric was washed using a home-use electric washing machine with water of 40° C. temperature, and after hanged to be dried, pilling generated states are classified into grades (JIS L0217 103 method Hang drying).

For the reduction ratio, a test fabric was washed using a home-use electric washing machine with water of 40° C. temperature, and the reduction ratio after tumble drying was measured (JIS L0217 103 method Tumble).

For nap adhesion, degrees of nap adhesion were classified into grades based on QTEC (Japan Textile Products Quality and Technology Center) Sellotape (Registered Trademark) method.

Soft feeling, warmth, and sweat/moisture absorption were evaluated in three stages by a functional inspection through tactile sense.

The evaluation results in Table 1 above will be explained.

The fifth grade of the pilling property is very good with almost no pilling. The fourth grade is good with a little pilling. In the third grade, some pilling is generated. The second grade is somewhat bad with much pilling. The first grade is bad with significant amount of pilling. Note that the third grade and above are accepted.

The fifth grade of nap adhesion is very good with almost no nap adhesion. The fourth grade is good with a little nap adhesion. In the third grade, some naps are adhered. The second grade is somewhat bad with much nap adhesion. The first grade is bad with significant amount of nap adhesion. Note that the third grade and above are accepted.

For soft feeling, ○ indicates soft and very good touch, Δ indicates good touch.

For warmth, ○ indicates very warm.

For sweat/moisture absorption, ○ indicates excellent. Δ indicates somewhat inferior. x indicates inferior.

As obvious from the results described above, with the method of manufacturing a fleece having different kinds of fibers in the front and back faces according to the present invention, it is possible to obtain a fleece which is supple, soft and good touch, and to suppress generation of static electricity since the electrification voltage decreases. Further, for the pilling property, fleeces manufactured by means of the present invention are in the fourth to fifth grades so they are excellent, however, conventional fleeces are in the third grade and below so they are defective. Therefore significant differences were found between them.

Although the main embodiment of the present invention has been explained above, the present invention is not limited to the examples above, and various design changes may be made within a range that the object of the present invention can be achieved without departing from the scope of the invention.

INDUSTRIAL APPLICABILITY

According to the present invention, not only materials for warm clothes but also materials for supporters for medical use, health bands, abdominal bodies, socks, bags, pouches, cushions, seat cushions, pillows and various covers may be obtained. Therefore, the present invention is widely applicable.

The invention claimed is:

1. A method of manufacturing a fleece having different kinds of fibers in front and back faces, comprising the steps of:

weaving an extra-fine polyester fiber or acrylic fiber in a high gauge to have dense loops so as to form the front face of loop piles, and weaving a natural fiber as a ground yarn of the back face;

cutting tip parts of the loop piles formed in the step of weaving so as to form cut piles;

raising the cut piles so as to form a raised fiber group;

trimming the raised fiber group;

causing pilling in the trimmed raised fiber group by a contact friction; and trimming the raised fiber group at least once so as to form a short raised fiber group.

2. The method of manufacturing a fleece having different kinds of fibers in the front and back faces, as claimed in claim 1, wherein the raised fiber group is extra-fine polyester or acrylic filament cluster yarns close to micro denier.

3. The method of manufacturing a fleece having different kinds of fibers in the front and back faces, as claimed in claim 1, wherein the short raised fiber group is trimmed to have a length of 1.0 to 3.0 mm.

4. The method of manufacturing a fleece having different kinds of fibers in the front and back faces, as claimed in claim 2, wherein the short raised fiber group is trimmed to have a length of 1.0 to 3.0 mm.

* * * * *